US007034798B2

(12) United States Patent
Masazumi et al.

(10) Patent No.: US 7,034,798 B2
(45) Date of Patent: Apr. 25, 2006

(54) LIQUID CRYSTAL DISPLAY DRIVING METHOD AND LIQUID CRYSTAL DISPLAY APPARATUS

(75) Inventors: Naoki Masazumi, Kobe (JP); Shuji Yoneda, Osaka (JP)

(73) Assignee: Minolta Co., Ltd., Osaka (JP)

( * ) Notice: Subject to any disclaimer, the term of this patent is extended or adjusted under 35 U.S.C. 154(b) by 339 days.

(21) Appl. No.: 10/221,508

(22) PCT Filed: Jan. 23, 2002

(86) PCT No.: PCT/JP02/00460

§ 371 (c)(1),
(2), (4) Date: Sep. 13, 2002

(87) PCT Pub. No.: WO02/073297

PCT Pub. Date: Sep. 19, 2002

(65) Prior Publication Data

US 2003/0043101 A1 Mar. 6, 2003

(30) Foreign Application Priority Data

Mar. 13, 2001 (JP) ..... 2001-71094

(51) Int. Cl.
*G09G 3/36* (2006.01)

(52) U.S. Cl. ..... 345/101; 345/95; 345/210

(58) Field of Classification Search ..... 345/87–104, 345/204–205, 208–210
See application file for complete search history.

(56) References Cited

U.S. PATENT DOCUMENTS 5,267,065 A * 11/1993 Taniguchi et al. ..... 345/97
5,748,277 A 5/1998 Huang et al. ..... 349/169
5,835,075 A 11/1998 Nomura et al. ..... 345/97
5,903,251 A * 5/1999 Mori et al. ..... 345/101
5,933,203 A * 8/1999 Wu et al. ..... 349/35
6,075,511 A * 6/2000 Iwasaki et al. ..... 345/101
6,278,429 B1 * 8/2001 Ruth et al. ..... 345/94
6,452,581 B1 * 9/2002 Katakura et al. ..... 345/101
6,717,561 B1 * 4/2004 Pfeiffer et al. ..... 345/87

FOREIGN PATENT DOCUMENTS

JP 09-258698 A 10/1997
JP 11-183877 A 7/1999
JP 2000-039521 A 2/2000
JP 2001-042812 A 2/2001
JP 2001-0512555 A 2/2001
WO WO 98/50804 A2 11/1998

OTHER PUBLICATIONS

U.S. Appl. No. 09/783,061, Pending, Masazumi et al.
J. Gandhi and D.-K. Yang, "*P-81: Temperature Compensation of the Dynamic Drive Scheme for Bistable Cholestric Displays*", SID 98 Digest, 1998, pp. 794-797.
English translation of International Search Report (ISR) concerning international application No. PCT/JP02/00460.
Y. M. Zhu et al, "9.1: High-Speed Dynamic Drive Scheme for Bistable Reflective Cholesteric Displays", *SID 97 Digest*, May 13, 1997, vol. 28, pp. 97-100.

* cited by examiner

*Primary Examiner*—Lun-Yi Lao
(74) *Attorney, Agent, or Firm*—Sidley Austin LLP

(57) ABSTRACT

A method of matrix-driving liquid crystal which exhibits a cholesteric phase and a liquid crystal display apparatus which is driven by the method. The method comprises a reset step Trs, a selection step Ts, an evolution step Trt and a display step Ti, and the selection step comprises a selection pulse application step Tsp, and a pre-selection step Tsz and a post-selection step Tsz' respectively before and after the selection pulse application step Tsp. The ratio of the length of the selection pulse application step Tsp to the length of the selection step Ts is changed with changes in temperature, and thereby, the temperature dependency of the responsibility of liquid crystal is compensated.

17 Claims, 8 Drawing Sheets

LIQUID CRYSTAL DISPLAY DRIVING METHOD AND LIQUID CRYSTAL DISPLAY APPARATUS

TECHNICAL FIELD

The present invention relates to a liquid crystal display driving method and a liquid crystal display apparatus, and more particularly to a liquid crystal display driving method in which pulse driving voltages are applied to liquid crystal through a plurality of scanning electrodes and a plurality of signal electrodes which face and cross each other, and a liquid crystal display apparatus which is driven by this method.

BACKGROUND ART

In recent years, reflective type liquid crystal displays which use liquid crystal which exhibits a cholesteric phase at room temperature (typically, chiral nematic liquid crystal) have been studied and developed to be used as media for transforming digital information into visual information. This is because such liquid crystal displays have the advantages of consuming little electric power and of being fabricated at low cost. Such liquid crystal displays which use liquid crystal with a memory effect, however, have the disadvantage of having a low driving speed.

In order to solve this problem, the present applicants suggested, in Japanese Patent Application No. 2000-39521, an improved method of driving a liquid crystal display of this kind. By this driving method, it is possible to drive such liquid crystal by a low voltage and at a high speed.

According to the driving method, in order to display an image on such a liquid crystal display, the following steps must be carried out: a reset step of resetting liquid crystal to an initial state; a selection step of selecting the final state of the liquid crystal; an evolution step of causing the liquid crystal to evolve to the selected state; and a display step of displaying an image. Further, the selection step is composed of a selection pulse application step of applying an selection pulse, and a pre-selection step and a post-selection step which are respectively before and after the selection pulse application step.

Incidentally, chiral nematic liquid crystal has a characteristic that its responsibility to an electric field applied thereto is dependent on temperature. Accordingly, a liquid crystal display which uses chiral nematic liquid crystal may make an incomplete display or may not be able to make a display thereon depending on the temperature. In order to solve this problem, it was suggested that the waveforms of driving pulses be changed similarly during all the driving steps by changing the basic clock with changes in temperature (see SID98 DIGEST, pages 794–797).

The available temperature range in which such a liquid crystal display is used must be designed to be sufficiently wide, for example, from −20° C. to 60° C. If the basic clock is changed for temperature compensation within this wide range, the length of the selection pulse application step, which is the reference of scanning, changes largely, which results in too large changes in scanning speed.

Also, as the temperature becomes higher, the selection pulse application step becomes shorter, and in order to send image data to a signal electrode driving IC during this very short period, a high performance driver is required. Thus, the cost for the driver becomes high.

In the above-described temperature compensation method in which all the driving pulses are changed similarly, both the following problems must be solved: when the temperature is low, the writing speed becomes low; and when the temperature is high, high-speed data transmission is required. Also, when the temperature is high, that is, when the selection pulse application step is short, the wave of the selection pulse may be deformed because of the relationship between the resistance of the electrodes and the capacity of the liquid crystal, and necessary driving energy may not be applied to the liquid crystal.

An object of the present invention is to provide a liquid crystal display driving method which carries out temperature compensation while solving the both problems of the reduction in writing speed within a low temperature range and of the necessity of high-speed data transmission within a high temperature range, and a liquid crystal display apparatus which is driven by this method.

Another object of the present invention is to provide a liquid crystal display driving method which, in addition to attainment of the above object, inhibits the influence of deformation of the selection pulse so as to apply necessary energy to the liquid crystal within a high temperature range, and a liquid crystal display apparatus which is driven by this method.

DISCLOSURE OF THE INVENTION

In order to attain the objects, the present invention relates to a liquid crystal display driving method wherein pulse driving voltages are applied to liquid crystal through a plurality of scanning electrodes and a plurality of signal electrodes which face and cross each other, and the method comprises a reset step of resetting the liquid crystal to an initial state, a selection step of selecting the final state of the liquid crystal and an evolution step of causing the liquid crystal to evolve to the state selected in the selection step. The selection step comprises a selection pulse application step of applying a selection pulse in accordance with image data, and the ratio of the length of the selection pulse application step to the length of the selection step is changed with changes in temperature.

A liquid crystal display apparatus according to the present invention comprises: a liquid crystal display which has a liquid crystal layer between a plurality of scanning electrodes and a plurality of signal electrodes which face and cross each other; and a driver for applying pulse driving voltages to the liquid crystal layer through the scanning electrodes and the signal electrodes. The pulse driving voltages applied from the driver comprise a reset step of resetting the liquid crystal to an initial state, a selection step of selecting the final state of the liquid crystal, an evolution step of causing the liquid crystal to evolve to the state selected in the selection step, and the selection step comprises a selection pulse application step of applying a selection pulse in accordance with image data. Also, the driver changes the ratio of the length of the selection pulse application step to the length of the selection step with changes in temperature.

In the liquid crystal display driving method and in the liquid crystal display apparatus according to the present invention, the selection step may comprise a pre-selection step and a post-selection step respectively before and after the selection pulse application step.

In the liquid crystal display method and the liquid crystal display apparatus according to the present invention, when the temperature changes, the ratio of the length of the selection pulse application step to the length of the selection step is changed for adjustment of the responsibility of the liquid crystal, which results in a temperature compensation. Merely by changing the ratio of the length of the selection pulse application step to the length of the selection step, without changing the length of the selection pulse application step, the change of the liquid crystal in responsibility with a change in temperature can be compensated to an extent. Thus, by adopting this temperature compensation method in which the ratio of the length of the selection pulse application step to the length of the selection step is changed with changes in temperature, the length of the selection pulse application step does not need to be changed largely within the entire available temperature range.

Therefore, in a low temperature range, the selection pulse application step does not need to be long for temperature compensation, and the reduction in writing speed can be avoided. Also, in a high temperature range, the selection pulse application step does not need to be very short for temperature compensation, and the driver is not required to perform very high-speed data transmission.

In the driving method and the liquid crystal display apparatus according to the present invention, a plurality of temperature ranges may be predetermined, and the ratio of the length of the selection pulse application step to the length of the selection step is changed depending on which of the temperature ranges the current temperature is in. Thereby, the control becomes easy. In this case, it is preferred that the border temperatures at which the ratio of the length of the selection pulse application step to the length of the selection step is changed are different between a case of raise in temperature and a case of drop in temperature. With this arrangement, there is an advantage that the scanning speed does not change so often.

Also, when the length of the selection pulse application step becomes shorter than a predetermined threshold value, preferably a selection pulse with only one polarity is applied. The selection pulse has only one polarity means that the width of the selection pulse is double the width of a bipolar selection pulse. Thereby, influence of deformation of the pulse wave is small, and a necessary voltage can be surely applied.

In a low temperature range, the ratio of the length of the selection pulse application step to the length of the selection step is small, and in a high temperature range, the ratio of the length of the selection pulse application step to the length of the selection step is large.

BEST MODE FOR CARRYING OUT THE INVENTION

Embodiments of a liquid crystal display driving method and a liquid crystal display apparatus according to the present invention are hereinafter described with reference to the accompanying drawings.

(Liquid Crystal Display; See FIG. 1)

First, a liquid crystal display which is driven by a method according to the present invention is described. The liquid crystal display comprises liquid crystal which exhibits a cholesteric phase.

Figure 1:
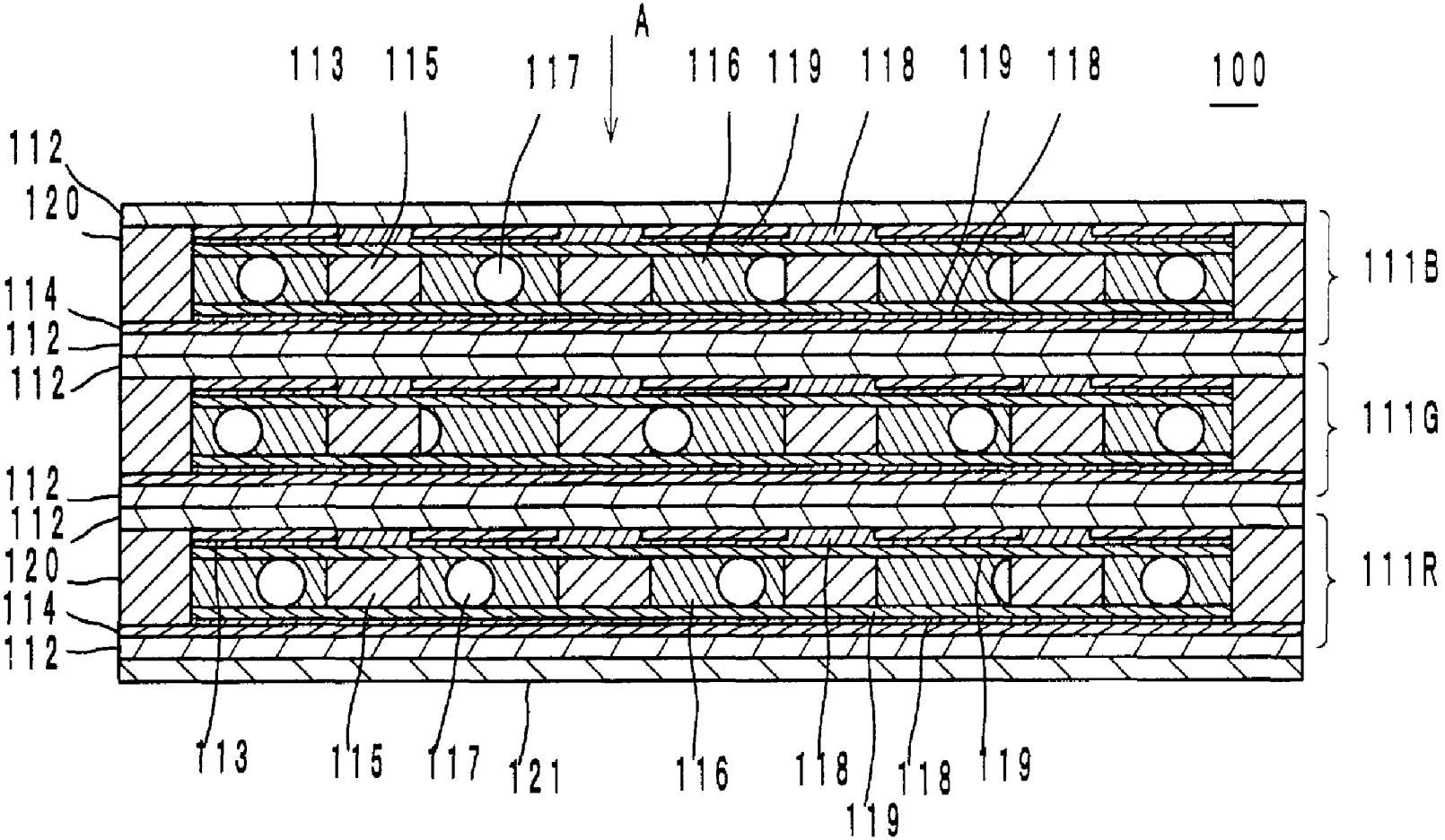
FIG. 1 is a sectional view of a liquid crystal display of a liquid crystal display apparatus according to the present invention.

FIG. 1 shows a reflective type full-color liquid crystal display which is driven by a simple matrix method. This liquid crystal display 100 comprises, on a light absorbing layer 121, a red display layer 111R, a green display layer 111G and a blue display layer 111B. The red display layer 111R makes a display by switching between a selective reflection state to selectively reflect light of red and a transparent state. The green display layer 111G makes a display by switching between a selective reflection state to selectively reflect light of green and a transparent state. The blue display layer 111B makes a display by switching between a selective reflection state to selectively reflect light of blue and a transparent state.

Each of the display layers 111R, 111G and 111B has, between transparent substrates 112 with transparent electrodes 113 and 114 thereon, resin nodules 115, liquid crystal 116 and spacers 117. On the transparent electrodes 113 and 114, an insulating layer 118 and an alignment controlling layer 119 are provided if necessary. Around the substrates 112 (outside a displaying area), a sealant 120 is provided to seal the liquid crystal 116 therein.

The transparent electrodes 113 and 114 are connected to driving ICs 131 and 132 (see FIG. 2) respectively, and a specified pulse voltage is applied between the electrodes 113 and 114. In response to the voltage applied, the liquid crystal 116 is switched between a transparent state to transmit visible light and a selective reflection state to selectively reflect light of a specified wavelength.

The transparent electrodes 113 and 114 in each of the display layers 111R, 111G and 111B are strip-like electrodes which extend in parallel at fine intervals. The extending direction of the strip-like electrodes 113 is perpendicular to the extending direction of the strip-like electrodes 114, and the electrodes 113 face the electrodes 114. Electric power is applied between the upper electrodes and the lower electrodes. In this way, voltages are applied to the liquid crystal 116 in a matrix way. This is referred to as matrix driving, and the intersections between the electrodes 113 and the electrodes 114 function as pixels. By carrying out matrix driving toward each of the display layers, a full-color image can be displayed on the liquid crystal display 100.

A liquid crystal display which has liquid crystal which exhibits a cholesteric phase between two substrates makes a display by switching the liquid crystal between a planar state and a focal-conic state. When the liquid crystal is in a planar state, the liquid crystal selectively reflects light of a wavelength $\lambda=Pn$ (P: helical pitch, n: average refractive index). When the liquid crystal is in a focal-conic state, if the wavelength of light selectively reflected by the liquid crystal is within the infrared spectrum, the liquid crystal scatters light, and if the wavelength of light selectively reflected by the liquid crystal is shorter than the infrared spectrum, the liquid crystal transmits visible light. Accordingly, by setting the wavelength of light to be selectively reflected by the liquid crystal within the visible spectrum and by providing a light absorbing layer on the side opposite the observing side of the display, the following colors can be seen on the liquid crystal; when the liquid crystal is in a planar state, the color of the light selectively reflected by the liquid crystal is displayed; and when the liquid crystal is in a focal-conic state, black is seen. Also, by setting the wavelength of light to be selectively reflected by the liquid crystal within the infrared spectrum and by providing a light absorbing layer on the side opposite the observing side of the display, the following colors can be seen on the liquid crystal; when the liquid crystal is in a planar state, the liquid crystal reflects light within the infrared spectrum but transmits visible light, and accordingly, black is seen; and when the liquid crystal is in a focal-conic state, the liquid crystal scatters light, and white is seen.

In the liquid crystal display 100 in which the display layers 111R, 111G and 111B are laminated, by setting the liquid crystal of the blue display layer 111B and the liquid crystal of the green display layer 111G to a focal-conic state, that is, a transmitting state and by setting the liquid crystal of the red display layer 111R to a planar state, that is, a selective reflection state, a display of red can be made. Also, by setting the liquid crystal of the blue display layer 111B to a focal-conic state, that is, a transmitting state and by setting the liquid crystal of the green display layer 111G and the liquid crystal of the red display layer 111R to a planar state, that is, a selective reflection state, a display of yellow can be made. Likewise, by setting the liquid crystal of the respective display layers to a transmitting state or a selective reflection state appropriately, displays of red, green, blue, white, cyan, magenta, yellow and black are possible. Further, by setting the liquid crystal of the respective display layers 111R, 111G and 111B in an intermediate selective reflection state, displays of intermediate colors are possible. Thus, the liquid crystal display 100 can be used as a full-color display.

The liquid crystal 116 preferably exhibits a cholesteric phase at room temperature, and especially chiral nematic liquid crystal which can be produced by adding a chiral agent to nematic liquid crystal is suited.

A chiral agent, when it is added to nematic liquid crystal, twists molecules of the nematic liquid crystal. When a chiral agent is added to nematic liqudi crystal, the liquid crystal molecules form a helical structure with uniform twist intervals, and thereby, the liquid crystal exhibits a cholesteric phase.

The liquid crystal display layers are not necessarily of the above-described structure. The resin nodules may be formed into a lattice or may be omitted. Also, the liquid crystal display layers may be of a polymer-dispersed liquid crystal composite layer type in which liquid crystal is dispersed in a three-dimensional polymer net or in which a three-dimensional polymer net is formed in liquid crystal.

(Driving Circuit; See FIG. 2)

Figure 2:
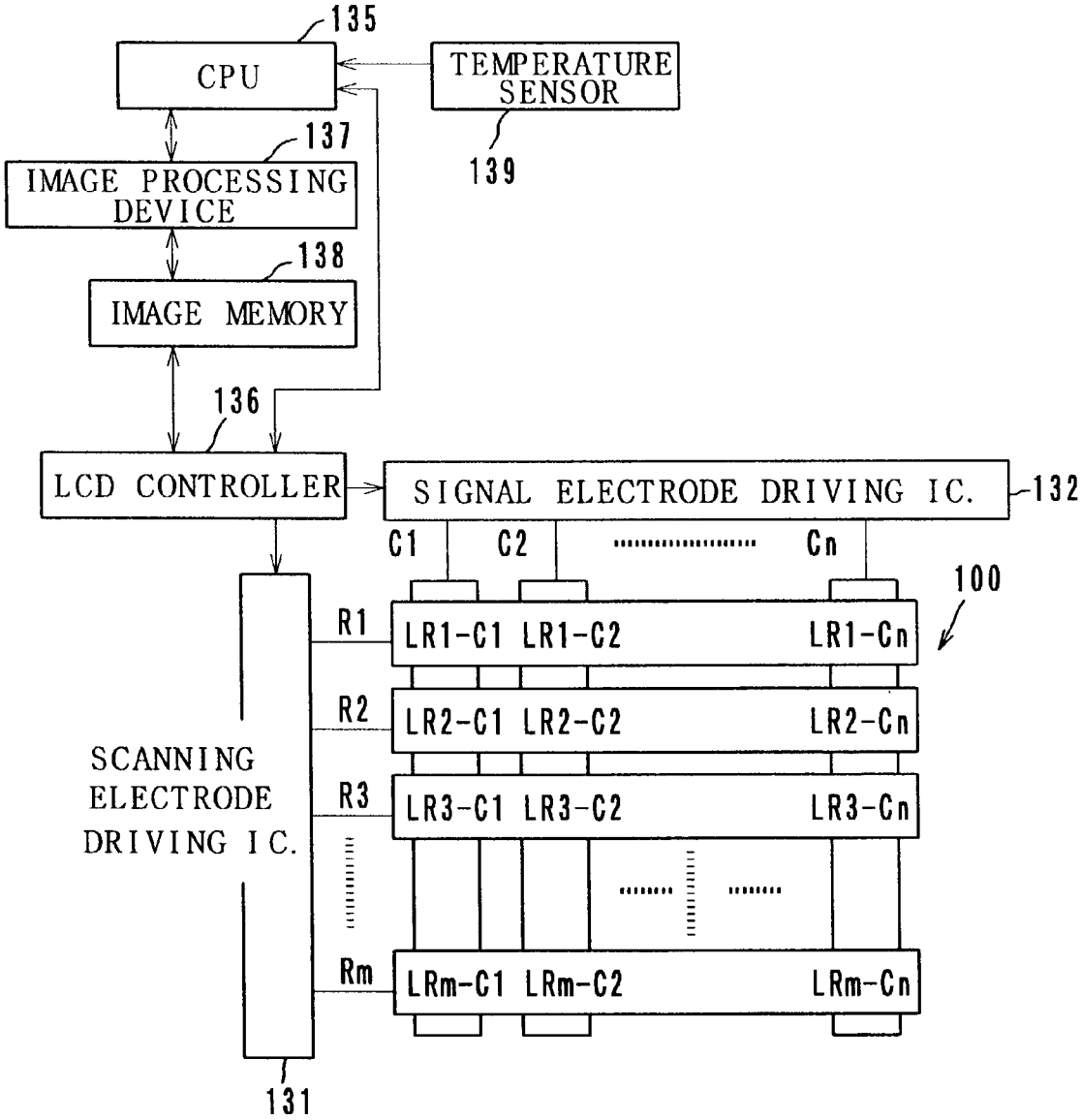
FIG. 2 is a block diagram which shows a control circuit of the liquid crystal display.

As FIG. 2 shows, the pixel structure of the liquid crystal display 100 is a matrix composed of a plurality of scanning electrodes R1, R2 through Rm and a plurality of signal electrodes C1, C2 through Cn (m, n: natural numbers). The scanning electrodes R1, R2 through Rm are connected to output terminals of a scanning electrode driving IC 131, and the signal electrodes C1, C2 through Cn are connected to output terminals of a signal electrode driving IC 132.

The scanning electrode driving IC 131 sends a selection signal to a specified one of the scanning electrodes R1, R2 through Rm while sending non-selection signals to the other scanning electrodes. The scanning electrode driving IC 131 sends the selection signal to the scanning electrodes switching from one to another at uniform time intervals. In the meantime, the signal electrode driving IC 132 sends signals to the signal electrodes C1, C2 through Cn simultaneously in accordance with image data so as to carry out writing on the pixels in the selected scanning electrode. For example, while a scanning electrode Ra (a: natural number, a≦m) is selected, the pixels LRa-C1 through LRa-Cn on the intersections between this scanning electrode Ra and the signal electrodes C1, C2 through Cn are simultaneously subjected to writing. Thus, in each pixel, the voltage difference between the scanning electrode and the signal electrode is a writing voltage, and writing on each pixel is carried out in accordance with the writing voltage.

A driving circuit comprises a CPU 135, an LCD controller 136, an image processing device 137, an image memory 138 and the driving ICs (drivers) 131 and 132. The LCD controller 136 controls the driving ICs 131 and 132 in accordance with image data stored in the image memory 138, and the driving ICs 131 and 132 apply voltages to the scanning electrodes and the signal electrodes of the liquid crystal display 100. Thus, an image is written on the liquid crystal display 100. Also, the CPU 135 receives temperature information from a temperature sensor 139. The structure of the driving ICs 131 and 132 will be described in detail later.

Writing of an image is carried out by selecting the scanning lines one by one. When writing on only part of the liquid crystal display 100 is desired, only the scanning lines which cover the part to be subjected to writing shall be selected one by one. Thereby, writing on only necessary part can be carried out, and it takes only a short time.

(Driving Principle; See FIG. 3)

First, the principle of a method of driving the liquid crystal display 100 is described. Although in the following specific examples, alternating pulse waves are used, the driving method does not necessarily use these waves.

Figure 3:
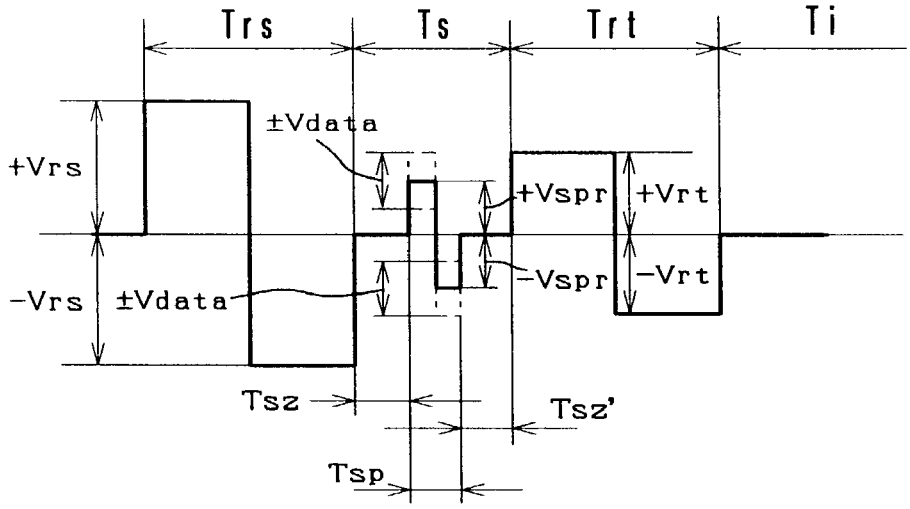
FIG. 3 is a chart which shows a basic driving wave in a driving method according to the present invention.

FIG. 3 shows a driving wave outputted from the scanning electrode driving IC 131 to each of the scanning electrodes. This driving method generally comprises a reset step Trs, a selection step Ts, an evolution step Trt and a display step Ti (which is also referred to as a crosstalk step). Further, the selection step Ts is composed of a selection pulse application step Tsp, a pre-selection step Tsz and a post-selection step Tsz'.

In the reset step Trs, reset pulses of ±Vrs are applied. In the selection pulse application step Tsp of the selection step Ts, selection pulses of ±Vspr are applied. In this step Tsp, further, pulses of ±Vdata are applied from the signal electrode driving IC 132. The pulses ±Vdata are determined depending on image data. In the step Tsp, actually voltages ±Vsp (=Vspr+Vdata or Vspr−Vdata) are applied to the liquid crystal. In the pre-selection step Tsz and in the post-selection step Tsz', 0 volt is applied. In the evolution step, evolution pulses of ±Vrt are applied.

Next, the state of the liquid crystal is described. First, when reset pulses of ±Vrs are applied in the reset step Trs, the liquid crystal is reset to a homeotropic state. Next, in the pre-selection step, 0 volt is applied, and then, the liquid crystal comes to the selection pulse application step. The waveform of the selection pulse applied in this step depends on whether the pixel is desired to finally come to a planar state or a focal-conic state.

First, a case of selecting a planar state as the final state of a pixel is described. In this case, in the selection pulse application step Tsp, selection pulses of ±(Vspr+Vdata) are applied, and thereby, the liquid crystal comes to a homeotropic state again. Thereafter, when 0 volt is applied in the post-selection step Tsz', the liquid crystal is twisted a little. Next, in the evolution step Trt, evolution pulses of ±Vrt are applied. Thereby, the liquid crystal, which has been twisted a little in the post-selection step Tsz', is untwisted and comes to a homeotropic state again.

In the display step Ti, crosstalk pulses act on the liquid crystal; however, the pulse widths of the crosstalk pulses are too narrow to influence the liquid crystal. When the voltage applied to the liquid crystal is set to 0, the liquid crystal in a homeotropic state comes to a planar state and thereafter stays in the same state.

Next, a case of selecting a focal-conic state as the final state of a pixel is described. In this case, in the selection pulse application step Tsp, selection pulses of ±(Vspr−Vdata) are applied. In the post-selection pulse Tsz', as in the case of selecting a planar state as the final state of a pixel, 0 volt is applied. Thereby, the liquid crystal is twisted, and the helical pitch becomes approximately double.

Next, in the evolution step, evolution pulses of ±Vrt are applied. Thereby, the liquid crystal, which has been twisted in the post-selection step Tsz', comes to a focal-conic state. In the display step Ti, as in the case of selecting a planar state as the final state of a pixel, crosstalk pulses act on the liquid crystal; however, the widths of the crosstalk pulses are too narrow to influence the liquid crystal. Even after the voltage applied to the liquid crystal becomes zero, the liquid crystal in a focal-conic state stays in the same state.

Scanning of each scanning electrode is carried out based on the length of the selection pulse application step Tsp, and at the end of the selection pulse application step of a scanning electrode, the selection pulse application step of the next scanning electrode starts.

In the driving method according to the present invention, temperature compensation is carried out by altering the ratio of the length of the selection pulse application step Tsp to the length of the selection step Ts with changes in temperature, and meanwhile, the problem of reduction in writing speed in a low temperature range and the problem of acceleration of data transmission in a high temperature range are solved. In the following, specific examples of this driving method are described.

(Driving Example 1; See FIGS. 4–7)

In the first driving example, the respective lengths of the reset step Trs, the selection step Ts, the selection pulse application step Tsp and the evolution step Trt are altered with changes in temperature as shown in Table 1 below.

TABLE 1

| Temperature (° C.) | Trs (ms) | Ts (ms) | Tsp (ms) | Trt (ms) |
|---|---|---|---|---|
| 60 | 11.2 | 0.14 | 0.14 | 11.2 |
| 55 | 12.8 | 0.16 | 0.16 | 12.8 |
| 50 | 14.4 | 0.18 | 0.18 | 14.4 |
| 45 | 18.4 | 0.23 | 0.23 | 18.4 |
| (40 | 22.4 | 0.28 | 0.28 | 22.4) |
| 40 | 22.4 | 0.28 | 0.09 | 22.4 |
| 35 | 31.2 | 0.39 | 0.13 | 31.2 |

TABLE 1-continued

| Temperature (° C.) | Trs (ms) | Ts (ms) | Tsp (ms) | Trt (ms) |
|---|---|---|---|---|
| 30 | 39.2 | 0.49 | 0.16 | 39.2 |
| 25 | 48 | 0.6 | 0.2 | 48 |
| 20 | 72 | 0.9 | 0.3 | 72 |
| 15 | 96 | 1.2 | 0.4 | 96 |
| 10 | 120 | 1.5 | 0.5 | 120 |
| (5 | 152 | 1.9 | 0.63 | 152) |
| 5 | 152 | 1.9 | 0.28 | 152 |
| 0 | 232 | 2.9 | 0.58 | 232 |
| −5 | 432 | 5.4 | 1.08 | 432 |
| (−10 | 760 | 9.5 | 1.9 | 760) |
| −10 | 760 | 9.5 | 1.36 | 760 |
| −15 | 1248 | 15.6 | 2.23 | 1248 |
| −20 | 2640 | 33 | 4.71 | 2640 |

Thus, the lengths of the reset step Trs, the selection step Ts and the evolution step Trt are designed to become longer as the temperature is getting lower and to become shorter as the temperature is getting higher. This design is made because the response speed of chiral nematic liquid crystal to a voltage applied thereto is slow when the temperature is low and is fast when the temperature is high.

For example, when the temperature is 25° C., the length of the selection step Ts is 0.6 ms, and the length of the selection pulse application step Tsp is 0.2 ms. In this case, Ts:Tsp=3:1. This ratio is constant within a temperature range from 5° C. to 35° C. Accordingly, in this temperature range, the length of the selection pulse application step Tsp changes within a range from 0.63 ms to 0.13 ms. Within a temperature range from 40° C. to 60° C., Ts:Tsp=1:1. Within this temperature range, the length of the selection pulse application step Tsp changes within a range from 0.28 ms to 0. 14 ms.

Within a temperature range from 5° C. to −10° C., Ts:Tsp=5:1. In this case, the length of the selection pulse application step Tsp changes within a range from 0.28 ms to 1.9 ms. Within a temperature range from −10° C. to −20° C., Ts:Tsp=7:1. In this case, the length of the selection pulse application step Tsp changes within a range from 1.36 ms to 4.71 ms.

In Table 1, the values in the brackets are virtual values at the border temperatures. The virtual values at a border temperature are to specify the rate of change of each kind of pulses within the temperature range right above the border temperature. In this embodiment, at a border temperature, the lengths of the respective steps are designed to take values which are not continual with the previous values; however, even at a border temperature, values which are continual with the previous values may be taken.

Figure 4:
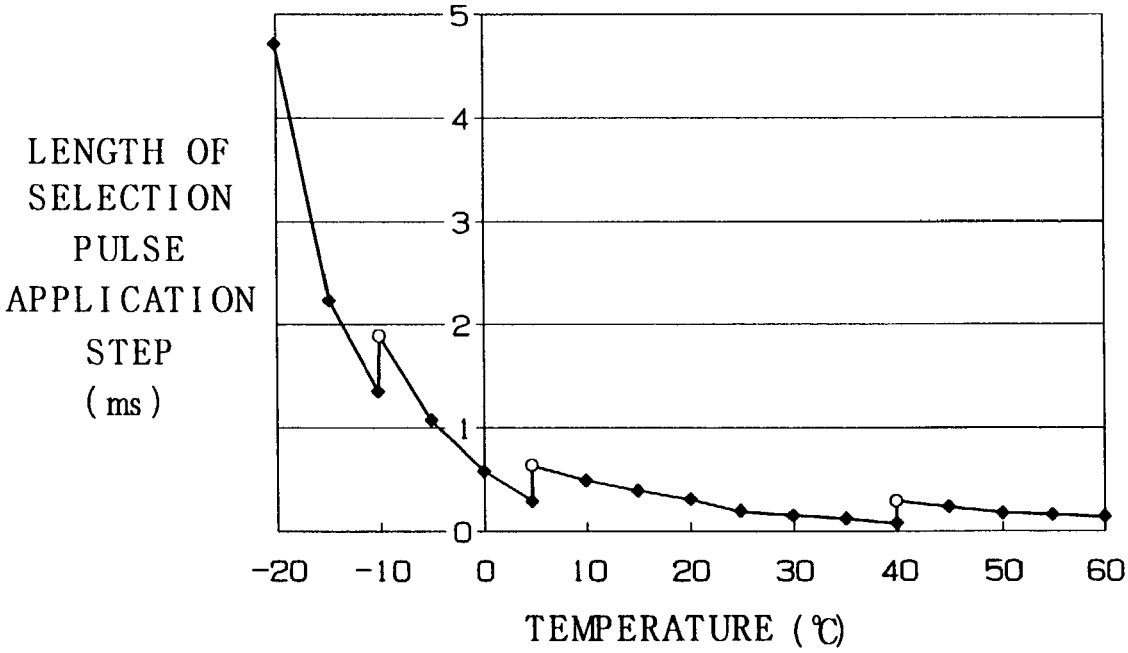
FIG. 4 is a graph which shows changes of the selection pulse application step in length with changes in temperature in a driving example 1.

FIG. 4 is a graph which shows the changes of the selection pulse application step Tsp in length with changes in temperature shown in Table 1. Thus, by taking the ratio Ts:Tsp peculiar to the temperature range in setting the length of the step Tsp, while the temperature changes within a range from −20° C. to 60° C., the length of the step Tsp can be set within a range from 0.14 ms to 4.71 ms.

On the other hand, in a conventional method in which the ratio Ts:Tsp is fixed to be, for example, 5:1 so as to change the pulse wave similarly, the length of the selection pulse application step Tsp is set within a range from 0.028 ms to 6.6 ms within the same temperature range −20° C. to 60° C. The rate of change of the length of the selection pulse application step according to the first driving example is approximately 1/7, which is very small compared with the conventional case.

Next, the voltages of the driving pulses Vrs, Vspr, Vrt and Vdata are shown in Table 2 below.

TABLE 2

| Temperature (° C.) | Vrs (V) | Vspr (V) | Vrt (V) | Vdata (V) |
|---|---|---|---|---|
| 60 | 40 | 6 | 20 | 4.5 |
| 55 | 40 | 6 | 20 | 4.5 |
| 50 | 40 | 6 | 20 | 4.5 |
| 45 | 40 | 6 | 20 | 4.5 |
| (40 | 40 | 6 | 20 | 4.5) |
| 40 | 40 | 9 | 20 | 4.5 |
| 35 | 40 | 9 | 20 | 4.5 |
| 30 | 40 | 9 | 20 | 4.5 |
| 25 | 40 | 9 | 20 | 4.5 |
| 20 | 40 | 9 | 20 | 4.5 |
| 15 | 40 | 9 | 20 | 4.5 |
| 10 | 40 | 9 | 20 | 4.5 |
| (5 | 40 | 9 | 20 | 4.5) |
| 5 | 40 | 11 | 20 | 4.5 |
| 0 | 40 | 11 | 20 | 4.5 |
| −5 | 40 | 11 | 20 | 4.5 |
| (−10 | 40 | 11 | 20 | 4.5 |
| −10 | 40 | 13 | 20 | 4.5 |
| −15 | 40 | 13 | 20 | 4.5 |
| −20 | 40 | 13 | 20 | 4.5 |

As described above, since the ratio Ts:Tsp is peculiar to each temperature range, the voltage of the selection pulse Vspr is set in accordance with the ratio Ts:Tsp. The voltages Vrs, Vrt and Vdata are fixed and are not changed with changes in temperature.

Figure 5:
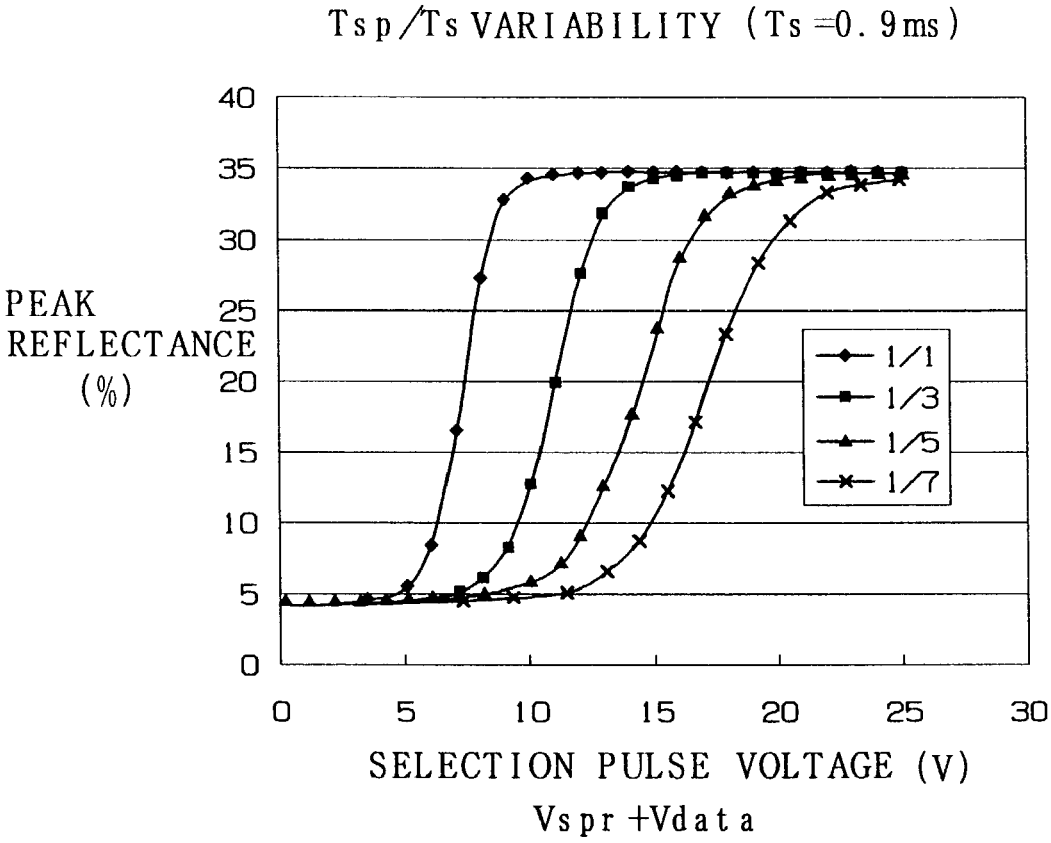
FIG. 5 is a graph which shows the peak reflectance of the liquid crystal in accordance with selection pulse voltage in the driving example 1.

FIG. 5 shows peak reflectance of the liquid crystal in response to the selection pulse voltage when the ratio Ts:Tsp is 1:1, 3:1, 5:1 and 7:1. As the ratio Ts:Tsp becomes larger, the selection pulse voltage must be higher, and when the rate Tsp/Ts is larger, only a lower voltage is necessary to select a bright state (planar state).

Specifically, when Ts:Tsp=1:1, the voltage Vspr is set to 6V. The voltage Vdata is always set to ±4.5V. Accordingly, in this case, a selection pulse of 6+4.5=10.5V acts on the liquid crystal to select a bright state, and a selection pulse of 6−4.5=1.5V acts on the liquid crystal to select a dark state.

When Ts:Tsp=3:1, the voltage Vspr is set to 9V, and when Ts:Tsp=5:1, the voltage Vspr is set to 11V. When Ts:Tsp=7:1, the voltage Vspr is set to 13V.

Figure 6:
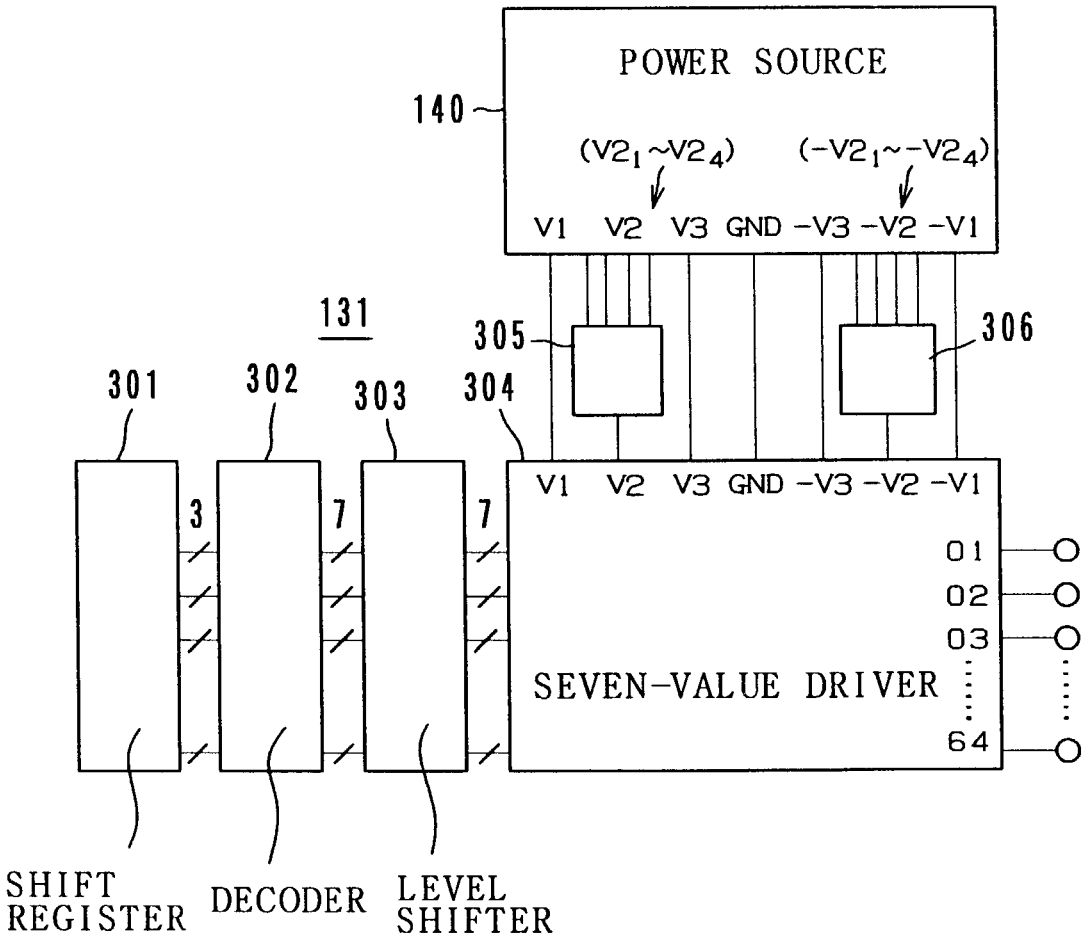
FIG. 6 is a block diagram which shows a control circuit of a scanning electrode driving IC.

FIG. 6 shows the internal circuit and the power source 140 of the scanning electrode driving IC 131 which outputs the driving pulses shown in FIG. 3. The scanning electrode driving IC 131 comprises a shift register 301, a decoder 302, a level shifter 303 and a seven-value driver 304.

The power source 140 outputs voltages ±V1, ±V2 and ±V3. The voltage V1 is the reset voltage Vrs. The voltage V2 is the selection voltage Vspr, and in order to write intermediate tones, four values $\pm V2_1$ through $\pm V2_4$ are selectable. The voltage V3 is the evolution voltage Vrt. The voltages ±V1 and ±V3 are supplied directly to the driver 304, and with respect to the voltage ±V2, a voltage which is selected from $\pm V2_1$ through $\pm V2_4$ by analog switches 305 and 306 is supplied to the driver 304.

To the shift register 301, three-bit data which indicate the seven kinds of voltages ±V1, ±V2, ±V3 and GND are inputted. These data are decoded by a decoder 302, and the level shifter 303 selects ±V1, ±V2, ±V3 or GND as an output from the driver 304 to each of the scanning electrodes. In accordance with the selection by the level shifter 304, the driver 304 outputs either one of the seven voltages to each of the scanning electrodes.

Figure 7:
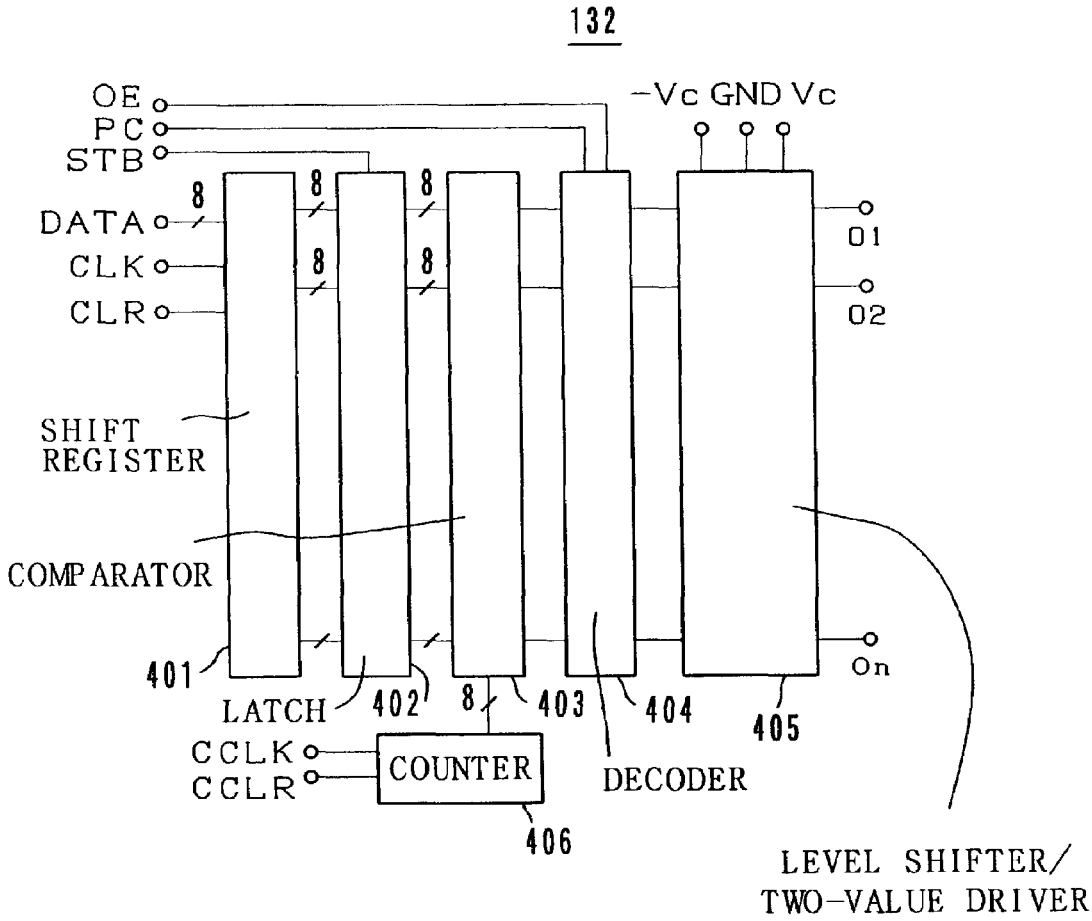
FIG. 7 is a block diagram which shows a control circuit of a signal electrode driving IC.

FIG. 7 shows the internal circuit of the signal electrode driving IC 132 which outputs the pulses ±Vdata. The signal electrode driving IC comprises a shift register 401, a latch 402, a comparator 403, a decoder 404, a level shifter/two-value driver 405 with a high withstand voltage and a counter 406. A voltage +Vc inputted to the driver 405 is the pulse voltage +Vdata, and a voltage −Vc is the pulse voltage −Vdata.

In the signal electrode driving IC 132, an output enable signal OE and a polarity conversion signal PC are inputted to the decoder 404, and a strobe signal STB is inputted to the latch 402. An eight-bit data signal DATA, a shift clock signal CLK and a clear signal CLR are inputted to the shift register 401, and a clock signal CCLK and a clear signal CCLR are inputted to the counter 406.

Now, the operation of the signal electrode driving IC 132 is described. When the eight-bit data signal DATA and the shift clock signal CLK are inputted to the shift register 401, the shift register 401 sets the eight-bit data therein. Next, in response to the strobe signal STB, the data in the shift register 401 is latched in the latch 402. Then, in synchronization with the clock signal CCLK inputted to the counter 406, the eight-bit output is counted up from 0. The comparator 403 compares the output of the latch 402 with the output of the counter 406, and while the output of the latch 402 is larger, the comparator 406 outputs a high-level signal. Thereafter, when the counting of the counter 406 proceeds until the output of the latch 402 becomes smaller than the output of the counter 406, the comparator 406 outputs a low-level signal. Then, in accordance with the output of the comparator 403, the output enable signal OE and the polarity conversion signal PC, the decoder 404 outputs a signal to drive the level shifter/two-value driver 405.

(Driving Example 2)

The second driving example is to drive the liquid crystal based on the driving principle shown by FIG. 3, and the second driving example is carried out basically in the same way as the first driving example. The characteristic of the second driving example is that the border temperatures where the ratio of the length of the selection pulse application step Tsp to the length of the selection step Ts is changed are different between a case of rise in temperature and a case of drop in temperature.

Figure 8:
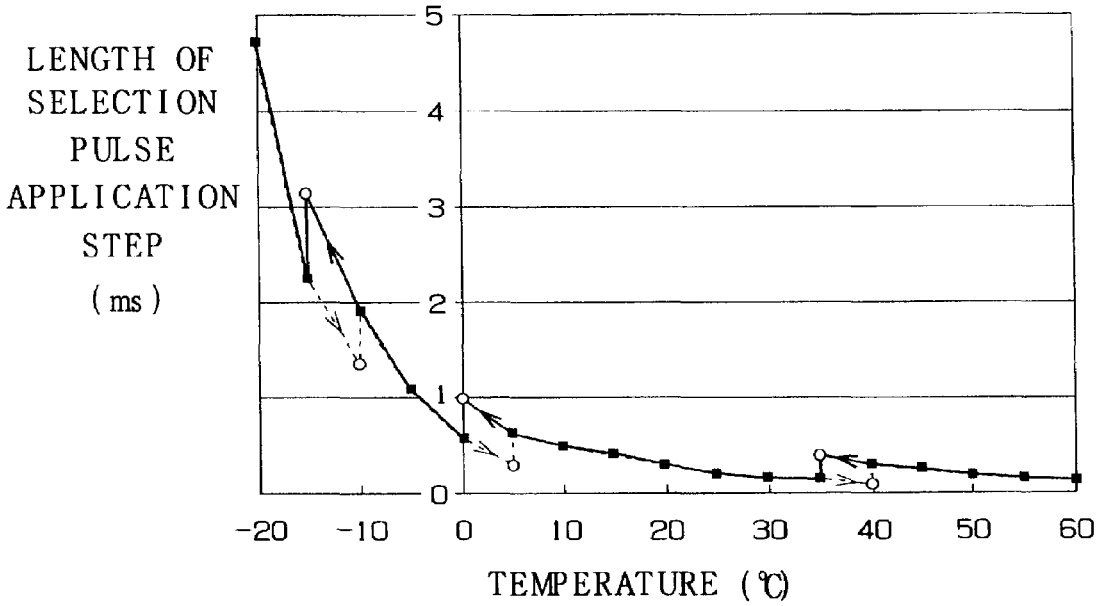
FIG. 8 is a graph which shows changes of the selection pulse application step in length with changes in temperature in driving example 2.

FIG. 8 shows changes of the selection pulse application step Tsp in length with changes in temperature. The length of the selection pulse application step Tsp is partly different between a case of rise in temperature and a case of drop in temperature. In FIG. 8, the solid line shows a case of drop in temperature, and the dashed line shows a case of rise in temperature.

Specifically, in a case of rise in temperature, the ratio Ts:Tsp is changed step by step at −10° C., 5° C. and 40° C., and in a case of drop in temperature, the ratio Ts:Tsp is changed step by step at 35° C., 0° C. and −15° C.

Since the border temperatures where the ratio Ts:Tsp is changed are different between a case of rise in temperature and a case of drop in temperature, even while the display is used around one of the border temperatures, the scanning speed does not change so often.

(Driving Example 3)

The third driving example is to drive the liquid crystal based on the driving principle shown by FIG. 3, and the third driving example is carried out basically in the same way as the first driving example. In the third driving example, when the length of the selection pulse application step Tsp is shorter than a predetermined threshold value, a selection pulse with only one polarity is applied to the liquid crystal.

Figure 9:
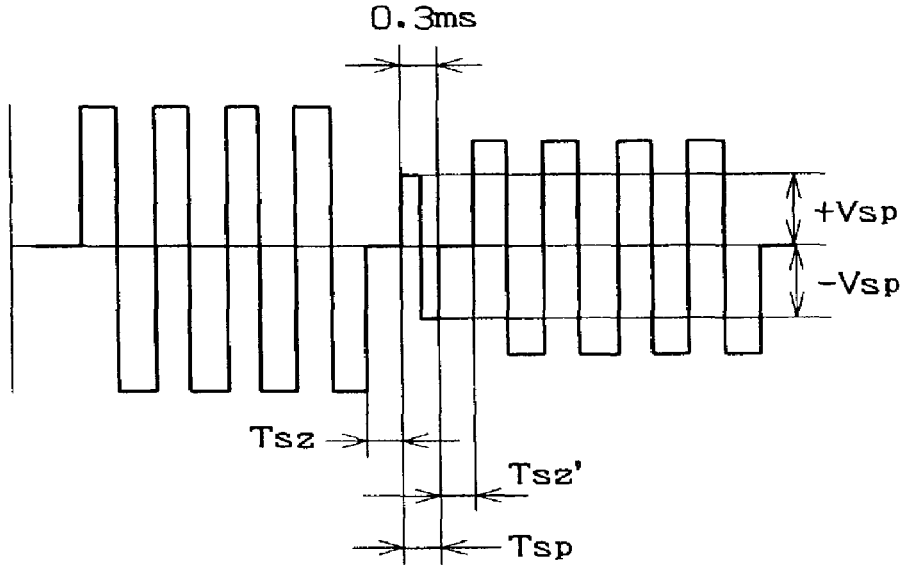
FIG. 9 is a chart which shows a driving pulse wave in a driving example 3.
Figure 9:
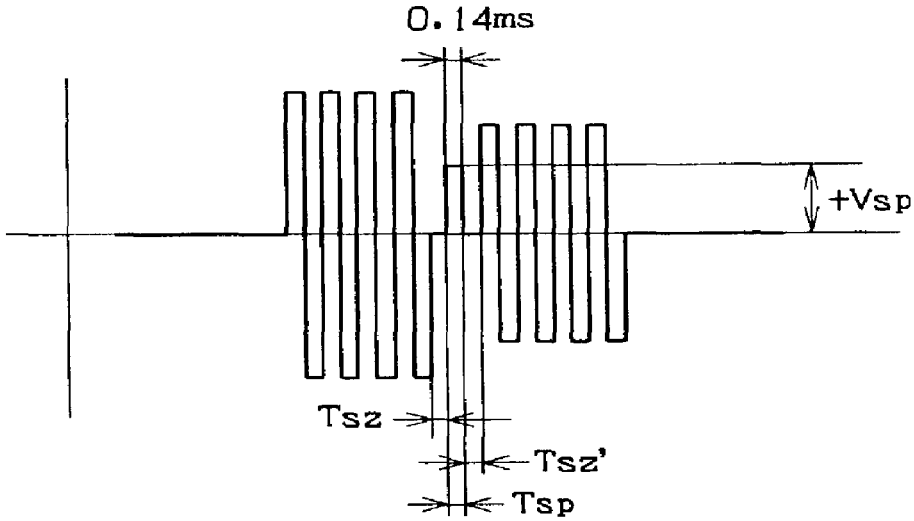

For example, if the threshold value of the length of the selection pulse application step Tsp is 0.3 ms, when the step Tsp has a length not less than 0.3 ms, the selection pulse is bipolar; however, when the step Tsp has a length less than 0.3 ms, the selection pulse has only one polarity. FIG. 9(A) shows a driving wave when the selection pulse application step Tsp has a length of 0.3 ms at a temperature of 20° C. In this case, the selection pulse is bipolar and is of voltages ±Vsp. FIG. 9(B) shows a driving wave when the selection pulse application step Tsp has a length of 0.14 ms at a temperature of 60° C. In this case, the selection pulse has only one polarity and is of a voltage +Vsp.

In the third driving example, the width of the selection pulse is at least 0.14 ms. If the width of the selection pulse is very narrow, because of deformation of the pulse wave, the voltage applied to the liquid crystal will not be sufficient. This third example is to avoid such trouble. In the third example, other influences of deformation of the pulse wave can be also suppressed.

(Other Embodiments)

Although the present invention has been described in connection with the preferred embodiments above, it is to be noted that various changes and modifications are possible to those who are skilled in the art. Such changes and modifications are to be understood as being within the present invention.

The structure, the materials and the producing method of the liquid crystal display are arbitrary, and the liquid crystal display may be of any other structure than the three-layered structure composed of R, G and B and may be of a monolayer structure. The voltages, the times and the temperatures of the driving pulse waves shown by the tables and the drawings are merely examples. In the above examples 1, 2 and 3, the ratio Ts:Tsp is changed step by step with changes in temperature; however, it is possible to change the ratio continuously in all the temperature ranges.

The invention claimed is:

1. A liquid crystal display driving method wherein pulse driving voltages are applied to liquid crystal through a plurality of scanning electrodes and a plurality of signal electrodes which face and cross each other, the liquid crystal exhibiting a cholesteric phase at room temperature, wherein:

said driving method comprises a reset step of resetting the liquid crystal to an initial state, a selection step of selecting a final state of the liquid crystal and an evolution step of causing the liquid crystal to evolve to the state selected in the selection step;

the selection step comprises a selection pulse application step of applying a selection pulse in accordance with image data; and a ratio of a length of the selection pulse application step to a length of the selection step is changed with changes in temperature, such that the ratio is small in a low temperature range due to a length of the selection pulse application step being long and such that the ratio is large in a high temperature range due to the length of the selection pulse application step being short.

2. A liquid crystal display driving method according to claim 1, wherein the selection step comprises a pre-selection step and a post-selection step respectively before and after the selection pulse application step.

3. A liquid crystal display driving method according to claim 1, wherein the ratio of the length of the selection pulse application step to the length of the selection step is changed for a plurality of predetermined temperature ranges.

4. A liquid crystal display driving method according to claim 3, wherein in each of the plurality of predetermined temperature ranges, a total length of a cycle of steps is changed with changes in temperature while the ratio of the lengths of the respective steps to one another is fixed.

5. A liquid crystal display driving method according to claim 1, wherein border temperatures where the ratio of the length of the selection pulse application step to the length of the selection step is changed are different between a case of rise in temperature and a case of drop in temperature.

6. A liquid crystal display driving method according to claim 1, wherein when the length of the selection pulse application step is shorter than a predetermined threshold value, a selection pulse with only one polarity is applied.

7. A liquid crystal display apparatus comprising a liquid crystal display which has a liquid crystal layer between a plurality of scanning electrodes and a plurality of signal electrodes which face and cross each other and a driver for applying pulse driving voltages to the liquid crystal layer through the scanning electrodes and the signal electrodes, the liquid crystal layer comprising a liquid crystal exhibiting a cholesteric phase at room temperature, wherein:

the pulse driving voltages comprise a reset step of resetting the liquid crystal to an initial state, a selection step of selecting a final state of the liquid crystal and an evolution step of causing the liquid crystal to evolve to the state selected in the selection step;

the selection step comprises a selection pulse application step of applying a selection pulse in accordance with image data; and the driver changes a ratio of the length of the selection pulse application step to the length of the selection step with changes in temperature, such that the ratio is small in a low temperature range due to a length of the selection pulse application step being long and such that the ratio is large in a high temperature range due to the length of the selection pulse application step being short.

8. A liquid crystal display apparatus according to claim 7, wherein the selection step comprises a pre-selection step and a post-selection step respectively before and after the selection pulse application step.

9. A liquid crystal display driving method wherein pulse driving voltages are applied to liquid crystal through a plurality of scanning electrodes and a plurality of signal electrodes which face and cross each other, wherein:

said driving method comprises a reset step of resetting the liquid crystal to an initial state, a selection step of selecting a final state of the liquid crystal, and an evolution step of causing the liquid crystal to evolve to the state selected in the selection step;

the selection step comprises a selection pulse application step of applying a selection pulse in accordance with image date;

a ratio of a length of the selection pulse application step to a length of the selection step is changed with changes in temperature;

the ratio of the length of the selection pulse application step to the length of the selection step is small in a low temperature range; and the length of the selection pulse application step is long in the low temperature range.

10. A liquid crystal display driving method according to claim 9, wherein the liquid crystal exhibits a cholesteric phase at room temperature.

11. A liquid crystal display driving method wherein pulse driving voltages are applied to liquid crystal through a plurality of scanning electrodes and a plurality of signal electrodes which face and cross each other, wherein:

said driving method comprises a reset step of resetting the liquid crystal to an initial state, a selection step of selecting a final state of the liquid crystal, and an evolution step of causing the liquid crystal to evolve to the state selected in the selection step;

the selection step comprises a selection pulse application step of applying a selection pulse in accordance with image date;

a ratio of a length of the selection pulse application step to a length of the selection step is changed with changes in temperature;

the ratio of the length of the selection pulse application step to the length of the selection step is large in a high temperature range; and the length of the selection pulse application step is short in the high temperature range.

12. A liquid crystal display driving method according to claim 11, wherein the liquid crystal exhibits a cholesteric phase at room temperature.

13. A liquid crystal display apparatus comprising a liquid crystal display which has a liquid crystal layer between a plurality of scanning electrodes and a plurality of signal electrodes which face and cross each other and a driver for applying pulse driving voltages to the liquid crystal layer through the scanning electrodes and the signal electrodes, the liquid crystal layer comprising liquid crystal exhibiting a cholesteric phase at room temperature, wherein:

the pulse driving voltages comprise a reset step of resetting the liquid crystal to an initial state, a selection step of selecting a final state of the liquid crystal, comprising a selection pulse application step, and an evolution step of causing the liquid crystal to evolve to the state selected in the selection step;

the driver applies a reset pulse to the scanning electrodes in the reset step, applies a selection pulse to the scanning electrodes in the selection pulse application step, and applies an evolution pulse to the scanning electrodes in the evolution step;

the driver applies a pulse in accordance with image data to the signal electrodes in the selection pulse application step;

the selection step has a length from an end of the reset step to a start of the evolution step; and the driver changes a ratio of a length of the selection pulse application step to the length of the selection step with changes in temperature, such that the ratio is small in a low temperature range due to a length of the selection pulse application step being long and such that the ratio is large in a high temperature range due to the length of the selection pulse application step being short.

14. A liquid crystal display apparatus according to claim 13, wherein the evolution pulse applied to the scanning electrodes in the evolution step is of a higher voltage than the selection pulse applied to the scanning electrodes in the selection pulse application step.

15. A liquid crystal display apparatus according to claim 13, wherein the voltage of the selection pulse applied to the scanning electrodes is changed with changes in ratio of the length of the selection pulse application step to the length of the selection step.

16. A liquid crystal display apparatus according to claim 13, wherein the voltage of the reset pulse, the voltage of the pulse applied to the signal electrode, and the voltage of the evolution pulse are not changed with changes in temperature.

17. A liquid crystal display apparatus according to claim 13, wherein the ratio of the length of the selection pulse application step to the length of the selection step is changed referring to a table showing values of the length of the selection step and values of the length of the selection pulse application step for different temperatures.

* * * * *